US005171095A

United States Patent [19]

Davies et al.

[11] Patent Number: 5,171,095

[45] Date of Patent: Dec. 15, 1992

[54] HANDLING MULTI-COMPONENT COMPOSITIONS

[75] Inventors: John Davies, Syston; Raymond Hanson, Rearsby; Frank C. Price, Leicester, all of England

[73] Assignee: British United Shoe Machine Ltd., Leicester, England

[21] Appl. No.: 671,522

[22] Filed: Mar. 19, 1991

[30] Foreign Application Priority Data

Mar. 28, 1990 [GB] United Kingdom ..... 9006927
Mar. 28, 1990 [GB] United Kingdom ..... 9006928

[51] Int. Cl.[5] ..... A46B 11/02; A46B 13/04; A46B 11/06

[52] U.S. Cl. ..... 401/47; 401/209; 401/273; 401/278

[58] Field of Search ..... 401/5, 44–47, 401/209, 213, 270, 272, 273, 278

[56] References Cited

U.S. PATENT DOCUMENTS

| | | | |
|---|---|---|---|
| 2,692,402 | 10/1954 | Dechaux | 401/47 X |
| 3,084,069 | 4/1963 | Simon | 401/47 X |
| 3,142,084 | 7/1964 | McMullen | 401/46 |
| 4,037,977 | 7/1977 | Ronai | 401/209 |
| 4,932,094 | 6/1990 | McCowin | 401/270 X |

FOREIGN PATENT DOCUMENTS

| | | | |
|---|---|---|---|
| 3402614 | 8/1985 | Fed. Rep. of Germany | 401/209 |
| 1085994 | 2/1955 | France | 401/46 |
| 63044 | 3/1955 | France | 401/273 |
| 952395 | 3/1964 | United Kingdom | 401/46 |

*Primary Examiner*—Danton D. DeMille

[57] ABSTRACT

A device applying a two-component composition to a workpiece surface comprises an applicator head (384) to which the two components are supplied separately via tubes (726, 382) arranged one inside the other. The applicator head includes a ball member (392) over the surface of which the components supplied via the tubes can flow and be applied to the workpiece surface, substantially unmixed at the point of application. The applicator head (384) supports a rotary brush assembly (398) which, when its annular operating surface portion is pressed against the workpiece surface, serves both to mix the substantially still separate components on the workpiece surface and to spread the thus formed adhesive composition over the workpiece surface. A gravity-fed system (T, RV1, RV2) is provided for supplying a first component and a pressurized feed system (P, R, RV3, RV4) for supplying a second component respectively to first and second bellows units (756, 744) from which said quantities are then fed separately at a controlled rate to the point of application (380). For metering the two components the bellows units are caused to increase or decrease in volume at a controlled rate, such that the component flow rate therefrom is constant throughout their operation. A control device for controlling the bellows units includes a pivotal lever (762) to which each unit is connected by an articulated linkage (760, 778).

37 Claims, 6 Drawing Sheets

HANDLING MULTI-COMPONENT COMPOSITIONS

BACKGROUND OF THE INVENTION

This invention is concerned with handling multi-component compositions, e.g. comprising two or more components which, when mixed, form an adhesive composition. (Although the following disclosure describes only a system for the supply of two components, it will be appreciated that the system could readily be adapted to cater for three or more components, should the need arise, and the invention is to be understood as relating to systems for handling two or more components.)

Two-component adhesive compositions are well known, usually comprising a first component which is referred to as the "hardener" and a second component which is usually referred to as the "adhesive". Two-part adhesive compositions of this kind are for example polyurethane compositions, neoprene compositions and indeed rubber solutions.

In the case of such two-component compositions it is desirable to maintain the two components separate until they are required for use, since once they are mixed the composition tends to "cure" relatively rapidly, so that there is only a relatively short time available between mixing and application. Moreover, where the amount of composition applied in any one application is relatively small, it is not appropriate to pre-mix even a relatively small batch in preparation for a series of such application steps.

In the case of certain of these compositions, in particular the hardener must be handled with great care because of risks which could otherwise arise of injury to the operator or other people in the vicinity of its use. For example, it is undesirable to supply the hardener in a pressurised system unless adequate safeguards are taken against the risk of leakage, which could lead to the hardener being sprayed; such precautions, of course, are costly. Moreover, at least certain of the hardeners are susceptible of changing their characteristics in the presence of moisture, so that using a pressurised system which involves the use of air under pressure coming into contact with the hardener will require that air to be "dry air"; again this is a costly provision. Moreover, certain of the hardeners are known to become liable to cause an explosion when pressurised by the application of air under pressure.

Also in handling components which make up e.g. polyurethane or neoprene compositions, attention has to be given also to the dangers involved, especially in the case of the hardener, which may be toxic. Thus it is desirable that a closed, leak-proof, system be utilised for the supply of such components. In this regard, for example, it may be considered that a piston-an-cylinder arrangement, which relies upon seals (piston rings) to prevent leakage, would not be adequate, even though from the point of view of metering the provision of such arrangements for each component may be considered otherwise attractive.

OBJECTS OF THE INVENTION

It is therefore one of the objects of the present invention to provide an applicator device for applying a two-component composition to a workpiece surface, which applicator device avoids the problems of ensuring that sufficient, but not an excess of, adhesive composition is available for any given application step.

SUMMARY OF THE INVENTION

The invention thus provides an applicator device for applying a multi-component composition to a workpiece surface, comprising a rotary applicator head, characterised in that each component is separately supplied to the applicator head and applied thereby to the workpiece surface, mixing of the components being substantially effected on the workpiece surface by rotation of the applicator head while pressed against said surface.

It will thus be appreciated that using the applicator device in accordance with the invention, since the mixing of the components takes place only after application thereof to the workpiece surface, problems which could arise in the case of a pre-mixed batch of composition are eliminated.

For mixing the components as aforesaid, and at the same time spreading the adhesive composition thus mixed over the workpiece surface, conveniently the applicator head comprises a substantially annular (or circular) operating surface portion which is pressed against the workpiece surface; in practice, preferably such an operating surface portion surrounds the point at which the components are delivered to the workpiece surface. In a preferred embodiment, furthermore, the applicator head thus comprises a rotary brush assembly. This has the effect of not only mixing the components adequately, but also of "scrubbing" the composition into the workpiece surface.

Conveniently the applicator head comprises a ball member captively accommodated within a housing which provides an outlet through which the components can flow from the applicator head, such flow being controlled by the ball member. In such a case, furthermore, the components are separately supplied to the head in the region of a portion, remote from the outlet, of the surface of the ball member whereby each component flows, substantially unmixed with the other, over the ball surface to the outlet. More particularly, where the applicator head comprises a rotary brush assembly, conveniently the brush assembly is mounted on the housing and bristles thereof project beyond the end face of the housing in which the outlet is provided, the arangement being such that when the applicator head is pressed against the workpiece surface the bristles of the brush assembly deform and spread over the workpiece surface. Moreover, in a preferred embodiment of the applicator device the ball member projects from the outlet in the housing, spring means being provided for urging it into a sealing condition thus to prevent the flow of the components from the outlet, and the ball member being movable against the spring pressure out of such sealing condition thus to allow the flow of the components through the outlet, stop means being provided for maintaining the ball member in a position projecting from the outlet when moved out of its sealing condition, and the ball member thus being able to be pressed against the workpiece surface and thus to determine the amount of deformation and spread of the bristles of the brush assembly.

For supplying the components to the applicator head, conveniently tubular elements are connected each to a supply at one of the components, each of which elements terminates in the applicator head and thus serves to supply its component thereto as aforesaid. Moreover, in one embodiment, adapted for use with a two-component composition, one of the elements is accommodated within the other. In this way it is ensured that no mixing of the components can take place until they reach the delivery point which is in the region of said portion, remote from the outlet, of the surface of the ball member.

Where the applicator device is for use with a two-component adhesive composition, including a hardener and an adhesive, conveniently the hardener, which is supplied in relatively small quantities in terms of the total volume of the composition (more specifically 3% to 5% of the total volume of the composition), is supplied down said one element which is accommodated within the other. Moreover, desirably the supply system for the applicator device will be pressurised and in particular the supply of adhesive (but not of the hardener) will be pressurised, so that, when the applicator device is not in use, a risk could arise of adhesive being urged up the supply element for the hardener. In order to avoid such a risk, conveniently a non-return valve is fitted to said supply element. In addition, the supply element for the hardener may be mounted so as to be readily removable from within the other supply element, so that when the applicator device is not in use for a longer period, e.g. overnight, by removing said element the risk of undesired mixing can be eliminated.

For supplying appropriate quantities of each component to the applicator head, conveniently an adhesive supply system comprising a metering system is provided, said metering system comprising a variable-volume container for each component, together with control means effective, when expelling components from their containers, to control the rate of decrease of the volume of each container, and thus the flow rate at which the quantity of each component is expelled from its container, such that the ratio between the flow rates from the containers is maintained constant.

By so maintaining constant the ratio between the flow rates, it will be appreciated, properly metered quantities of each component may thus be supplied to the applicator head at a controlled rate sufficient for ensuring that appropriate quantities of the two components are supplied as aforesaid to the workpiece surface. Moreover, each container of the metering system is preferably a collapsible container which, except for an inlet/outlet, is otherwise closed. It will be appreciated that by using such a collapsible container no reliance need be placed upon sliding or rotating seals and thus the risk of leakage of either of the components is mitigated.

Conveniently the control means is also effective, prior to such expulsion, to cause a quantity of each component to be supplied to its container, the quantities thus supplied being in the same ratio as the ratio between their flow rates from the containers. In this way, the metering system always remains in an equilibrium state where at any given time the available volume of each component is in the correct ratio.

In a preferred embodiment the control means of the metering system comprises a single motor acting through a linkage including a pivotal lever to which each container is connected for collapsing it. More particularly, the pivotal lever is mounted for pivotal movement about a pivot point and the ratio of the flow rates from each container is determined according to the distance of the connection for each container from the pivot point as well as the actual volume of each container (or, in the case of a cylindrical container, the cross-sectional area thereof). It may of course be desirable, for different two- component compositions, to vary the ratio between the flow rates and to this end conveniently in accordance with the invention the position of the pivot pin about which the pivotal lever can pivot can be adjusted in a direction along the length of the lever.

The collapsible containers used in the metering system may be in the form of e.g. expansible bag members which have a plastic memory but preferably each collapsible container is constituted by a bellows unit. (Bellows units are formed either by the hydraulic deformation of a tube over a mould or form, or by electro-deposition onto such a mould or form, and are thus unitary, except for welding end closure members onto the thus formed tubular portions. Provided that the welding of the ends is complete, a closed chamber is thus provided.)

As already mentioned above, it may sometimes be undesirable to supply e.g. the hardener of a two-component adhesive composition using a pressurised system, and to this end the adhesive supply system of the device in accordance with the invention preferably comprises a gravity feed system for supplying a first of the components to a first variable-volume container, and a pressurised feed system for supplying a second of the components to a second variable-volume container. It will be appreciated that, using such an adhesive supply system, the risk of injury to an operator by spraying of the hardener is significantly mitigated, should a leak occur in the system, and moreover the risk of explosion by the pressure feeding of the hardener using compressed air is eliminated by the use of a gravity feed system for the initial supply of the hardener to the variable-volume container. To a degree, the use of a gravity feed system is facilitated by the fact that the hardener is of relatively low viscosity, that is to say flows freely under gravity, as compared with the adhesive which is much more viscous and thus requires the pressurised feed system for supplying it to the second variable-volume container. Thereafter, when the two components are expelled from their respective containers it is no longer a question of compressed air acting directly on the components but rather they are mechanically forced from the containers to the location at which they are then mixed. The variable-volume containers, furthermore, enable the relative quantities of the two components to be pre-determined so that the ratio between the two quantities can readily be set to achieve adequate cure of the adhesive composition without excessive use of the hardener; the generally accepted optimum quantity of hardener to be used is in the region of 3% to 5% of the total volume of the composition.

In a preferred embodiment of said adhesive supply system a first supply line extends from a tank (forming part of the gravity feed system) to said delivery point, the first container being connected into said first supply line via a first branch line, and a second supply line extends from a pressure source (forming part of the pressurised feed system) to said delivery point, the second container being connected into said second supply line through a second branch line. Clearly in the case of the gravity feed system the pressure in the first supply line will thus be less than the pressure applied to the component in said line during the expulsion of the first component from the first container. Conveniently, furthermore, the pressure in the second supply line is maintained at the pressure created by the pressure source, but is increased by the operation of the actuator means causing the volume of the second cylinder to be decreased and the component contained therein thus to be expelled into the second supply line, a restrictor valve arrangement being provided "upstream" of the branch line to direct the component flow in a direction towards the applicator head. Furthermore, in said preferred embodiment a restrictor valve arrangement is also provided in the first supply line, "upstream" of the first branch line to direct the component flow in a direction towards the applicator head.

The ball arranged in the applicator head of the device in accordance with the invention acts as a shut-off valve for preventing component flow from the system. In this way, the pressurised feed system may remain under pressure during the whole of the time when the adhesive supply system is required for use. Furthermore, the pressurising of the second component in this way is also effective to maintain the first component under the same pressure, and thus holds the first component against continuous flow under its gravity feed. If desired, a further restrictor valve arrangement may be provided in the first supply line also to prevent continuous flow under the force of gravity. In order to avoid any risk of the pressure applied by the second component to the first component causing the second component to be driven into the first supply line, a still further restrictor valve arrangement is provided in said supply line, "downstream" of the first branch line, and indeed adjacent the applicator head, whereby component flow in a direction away from the head is prevented.

BRIEF SUMMARY OF THE DRAWINGS

There now follows a detailed description, to be read with reference to the accompanying drawings, of a machine for applying adhesive to marginal portions of shoe bottoms, which machine incorporates an adhesive applicator device in accordance with the present invention. It will of course be realised that this machine and its various integers have been selected for description merely by way of exemplification of the invention and not by way of limitation thereof.

In the accompanying drawings.

DESCRIPTION OF THE PREFERRED EMBODIMENTS

Figure 1:
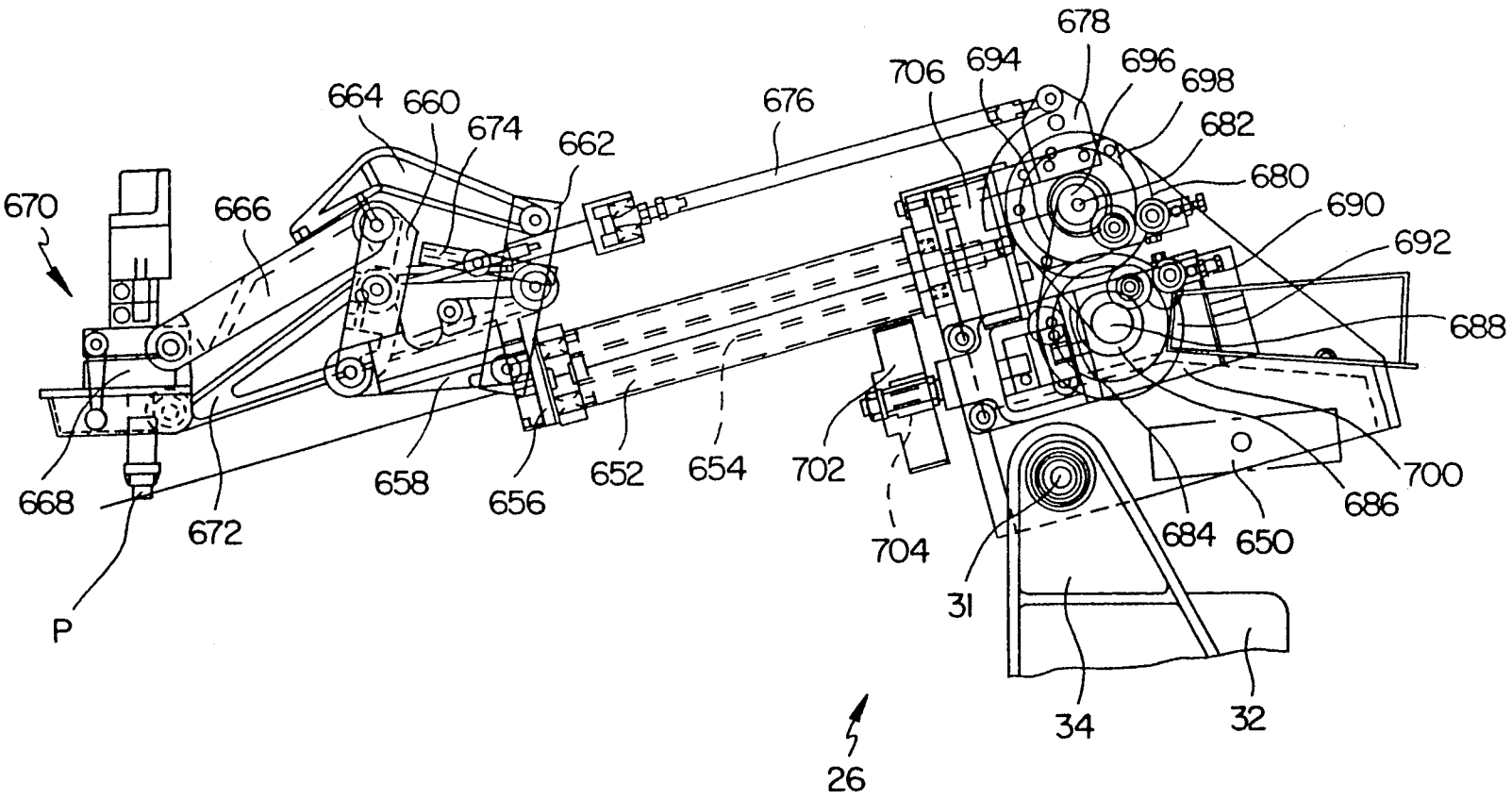
FIG. 1 is a view in side elevation of tool supporting means of the machine for supplying adhesive to marginal portions of shoe bottom, said means being shown supporting an adhesive applicator device in accordance with the invention arranged and adapted for use in applying adhesive to marginal portions of shoe bottoms.

The machine now to be described is generally similar, except as hereinafter described, to the machine described in EP-A0353881, being a machine for performing an adhesive-applying operation progressively along marginal portions of a shoe bottom. In this present specification reliance is placed upon said EP specification and indeed upon other EP specifications to which it in turn refers. Thus, where like parts are incorporated in the two machines but are not shown in the drawings of the present specification, the reference numerals from the relevant earlier specification are used but are placed in brackets to indicate that the parts are not shown in the present drawings.

The machine shown in the drawings thus comprises a base (10) supporting, by a bracket (12), a pivot shaft (14) about which a support (16) for a shoe support (18) can pivot. The shoe support is arranged to support a shoe (S) bottom uppermost, with the toe end thereof facing towards the front of the machine, i.e. towards the operator. At its rear, the base (10) supports a support column structure (22) carrying a casting (24) on which is supported, for pivotal movement about a vertical axis, a support casting 34 having two upstanding lugs 32 between which tool supporting means generally designated 26 is supported for pivotal movement about a horizontal axis 31.

The machine further comprises a first stepping motor (144) mounted on the base (10) and effective to cause pivotal movement of the shoe support (18) to take place about the horizontal axis provided by the shaft (14) (X-axis movement). Similarly, a second stepping motor (84) is provided, carried by the casting (24) and effective to cause pivotal movement of the support casting 34 about its vertical axis (Y-axis movement). In addition, a third stepping motor (122—described in EP-A0043645) is supported by the support casting 34, rearwardly of its vertical pivot, to cause it, and thus the tool supporting means 26 supported thereby, to pivot about its horizontal axis 31 (Z-axis movement). It will be appreciated that the X-, Y- and Z-axes represent three coordinate axes along which a tool supported by the tool supporting means 26 can move. Details of the shoe support (18) can be found in GB-A2077090, and further details of the construction by which movement along the three axes can take place can be found in EP-A0091321 and also in EP-A0043645.

The tool supporting means 26 comprises a housing 650 mounted for pivotal movement about said horizontal axis 31. From a forward face of the housing projects a hollow, tubular arm 652 within which is accommodated, for rotational movement therein, a support rod 654. At the forward end of said rod is a plate 656 supporting two forwardly projecting arms 658, which are spaced apart widthwise of the machine and on each of which is mounted, for pivotal movement, a pair of links 660, 662, upper ends of which pivotally support a plate 664. The links 660, 662, together with the plate 664 and arms 658, thus comprise a first parallel linkage arrangement of the tool supporting means.

Fixedly secured to a forward end of the plate 664, and projecting forwardly therefrom, is a further plate 666, in a forward, bifurcated, end of which is pivotally mounted a block 668 forming part of a tool holder generally designated 670. Also secured to the tool holder, at the left-hand side thereof, is a further link 672 which is in turn pivotally connected to each of the left-hand links 660, 662. The links 660, 662, tool holder 670, link 672 and composite plate 664, 666 thus constitute a second parallel linkage of the tool supporting means. The various pivots are so arranged in relation to one another that the tool holder is caused to pivot about an axis (a virtual centre) extending transversely of the bottom of a shoe supported by the shoe support (18) and passing through a point P, which lies on the axis of the support rod 654. As will be described hereinafter, furthermore, when a tool is supported in the tool holder 670, the axis of rotation thereof also passes through said point P. The point P represents a height datum of the machine in a desired relationship with which the bottom of a shoe supported by the shoe support (18) can be positioned by means of a holddown member (450) and toe support means (470) of said support. Furthermore, in a central position of the tool supporting means 26 the point P lies vertically above the axis (14) of the shoe support (18).

For effecting such pivotal, or tilting, movement of the tool holder 670 about the transverse axis, the links 662 carry therebetween a block 674 to which is pivotally connected a forward end of a push-rod 676, the rearward end of which is similarly pivotally connected to a block 678 which is mounted on a pulley 680 freely rotatable about a drive shaft 682., The pulley 680 is caused to rotate about said shaft by a timing belt 684 entrained around a second pulley 688, a tensioning pulley 690 being provided for maintaining the tension in the belt. Also mounted on the shaft 688 is a third pulley 692 around which is entrained a second timing belt 694 meshing with a fourth, drive, pulley 696 secured on the drive shaft 682. The shaft 682 is driven by a stepping motor 698. For effecting rotational movement of the support rod 654, a similar drive arrangement is provided comprising a stepping motor 700 acting through pulleys 702, 704, 706 (the fourth not being shown) and timing belts (not shown), the pulley 706 being fixedly mounted on the support rod 654.

Figure 2:
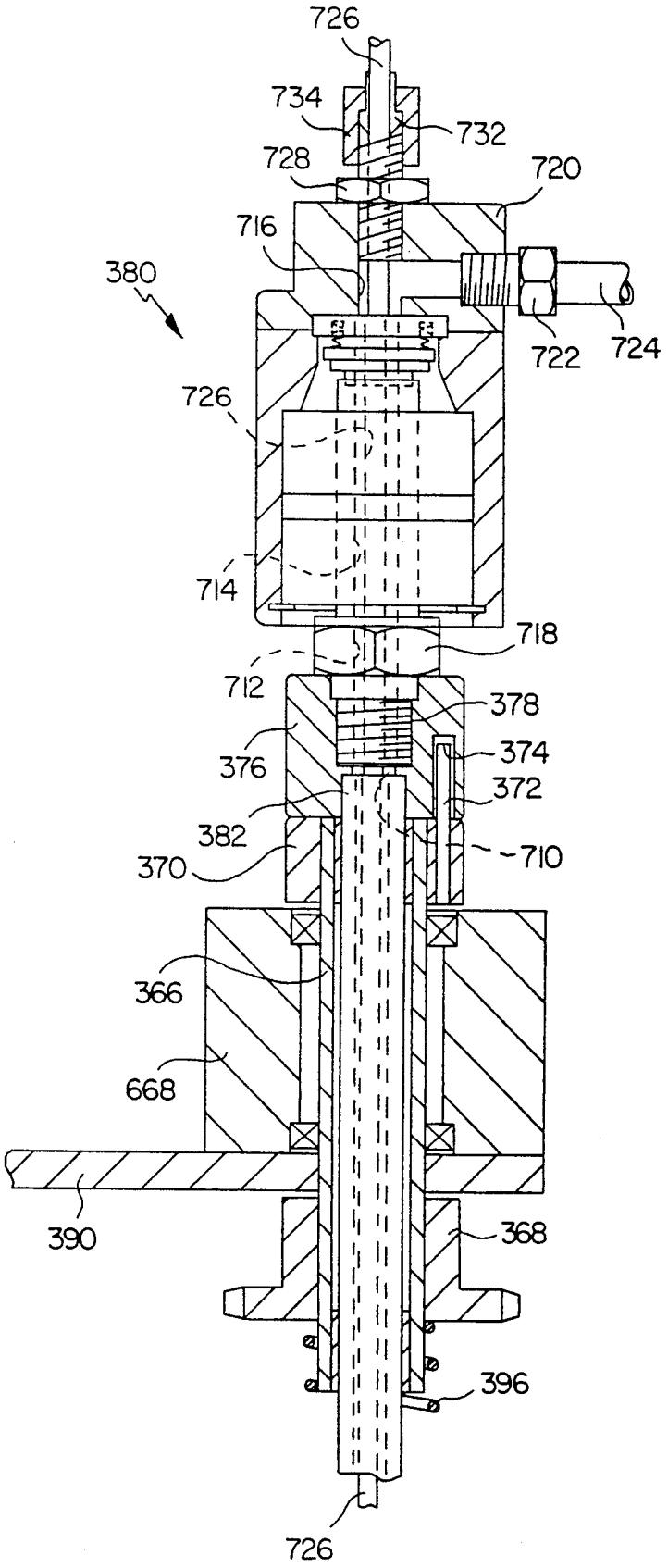
FIG. 2 is a fragmentary view, partly in section, showing details of the device shown in FIG. 1.
Figure 3:
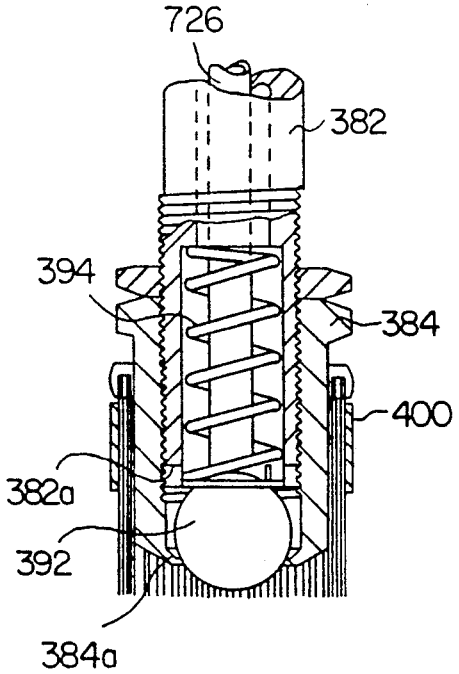
FIGS. 3 and 4 are fragmentary views showing a ball of the device shown in FIG. 2, respectively in a sealing position and moved out of said sealing position by engagement with a shoe bottom.
Figure 4:
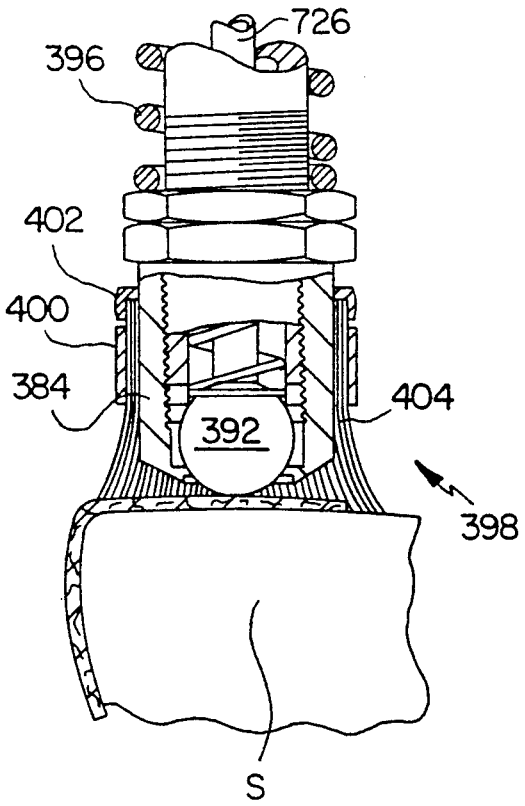

The tool holder 670 is arranged to support a tool generally designated 380 in the form of an adhesive applicator device in accordance with the present invention. This device is generally similar, except as hereinafter described, to the device described in EP-A0276944, the tool being fixedly mounted in the block 668. The adhesive applicator device 380 in accordance with the invention thus comprises a hollow shaft 366 (FIG. 2) mounted in the block 668 and carrying at its lower end a sprocket 368 pivotally connected by a chain (not shown but numbered 386 in said specification) to an electric motor also carried on the tool holder 670. At its upper end the shaft 366 carries a collar 370 in which is secured an upstanding pin 372 accommodated in a bore 374 of a further collar 376 which is threadedly secured to an output end 378 of a rotary coupling generally designated 380. Force-fitted into the collar 376, furthermore, is the upper end of an adhesive supply tube 382 which passes through the hollow shaft 366 and has screw-threaded on the lower end thereof a nozzle housing 384 (see FIGS. 3 and 4). It will thus be appreciated that rotation of the sprocket 368 causes, through the pin 372 and bore 374, rotation of the tube 382 and thus of the nozzle housing 384 secured thereto.

The nozzle housing 384, which forms part of a head of the applicator device, has a frustoconical lower end face 384*a* which provides an annular rim spaced from the lower end face 382*a* of the tube 382 to form therein a chamber in which a ball 392 is accommodated with a portion thereof projecting beyond the annular rim. A spring 394 is accommodated in a counter-sink formed in the lower end of the tube 382 and urges the ball against the annular rim into a sealing position in which adhesive flow through the nozzle is prevented. The application of pressure to the projecting portion of the ball 392, on the other hand, causes it to retract against the lower end 382*a* of said counter-sink, which is slotted so as to allow adhesive flow from the tube when the ball is urged thereagainst, such adhesive then flowing over the surface of the ball and out between the annular rim and the projecting portion of the ball.

It will thus be appreciated that, in using the device, pressing the ball 392 against a workpiece to be coated with adhesive causes the ball to retract, to allow adhesive to be supplied through the nozzle, the supply continuing until the ball is moved out of contact with the component whereupon sealing takes place substantially immediately with consequent cut-off of the adhesive. The ball is shown in its retracted condition in FIG. 4.

Secured to the outside of the nozzle housing 384, e.g. by a jubilee clip, is a brush assembly generally designated 398 which comprises a ring 402, e.g. of plastics material, which is slid along the nozzle housing and in which are embedded sets of bristles 404 arranged to form a cylindrical shape which surrounds the nozzle housing and projects beyond the end face 384*a*, being disposed about the whole of the periphery of said end face 384*a*. By virtue of its being fixed to the housing as aforesaid, the brush assembly 398 rotates with the nozzle housing 384.

The nozzle housing 384 is capable of "floating" relative to the block 668, that is to say excessive pressure applied to the ball is accommodated by sliding movement of the nozzle housing bodily in relation to the hollow shaft 366, so that any irregularities in the surface of the shoe bottom to be coated with adhesive, in relation to the heightwise path as determined by the third n.c. motor (122), can be accommodated. To ensure that the nozzle housing is urged into its lowered position, a further spring 396 is provided acting between the nozzle housing and the underside of the hollow shaft, the force applied by the spring 396 being significantly greater than that applied by the spring 394, so as to ensure that the ball will first retract when engaged. As can be seen from FIG. 1, when the housing is in its lowermost position it lies below the point P. In a "teaching" mode of operation (referred to hereinafter), in setting the Z-axis position desirably the operative surface portion of the tool is set at the point P, that is to say a certain amount of the "float" is taken up during teaching, thereby allowing variations of a plus or minus value from that position to take place according to any irregularities in the contour of the shoe bottom. Conveniently for determining the amount of float, the operator, when the machine is in its "teaching" mode, has regard to the distance between the two collars 370, 376. If desired, furthermore, a scale may be provided on one of the collars to assist the operator.

Figure 6:
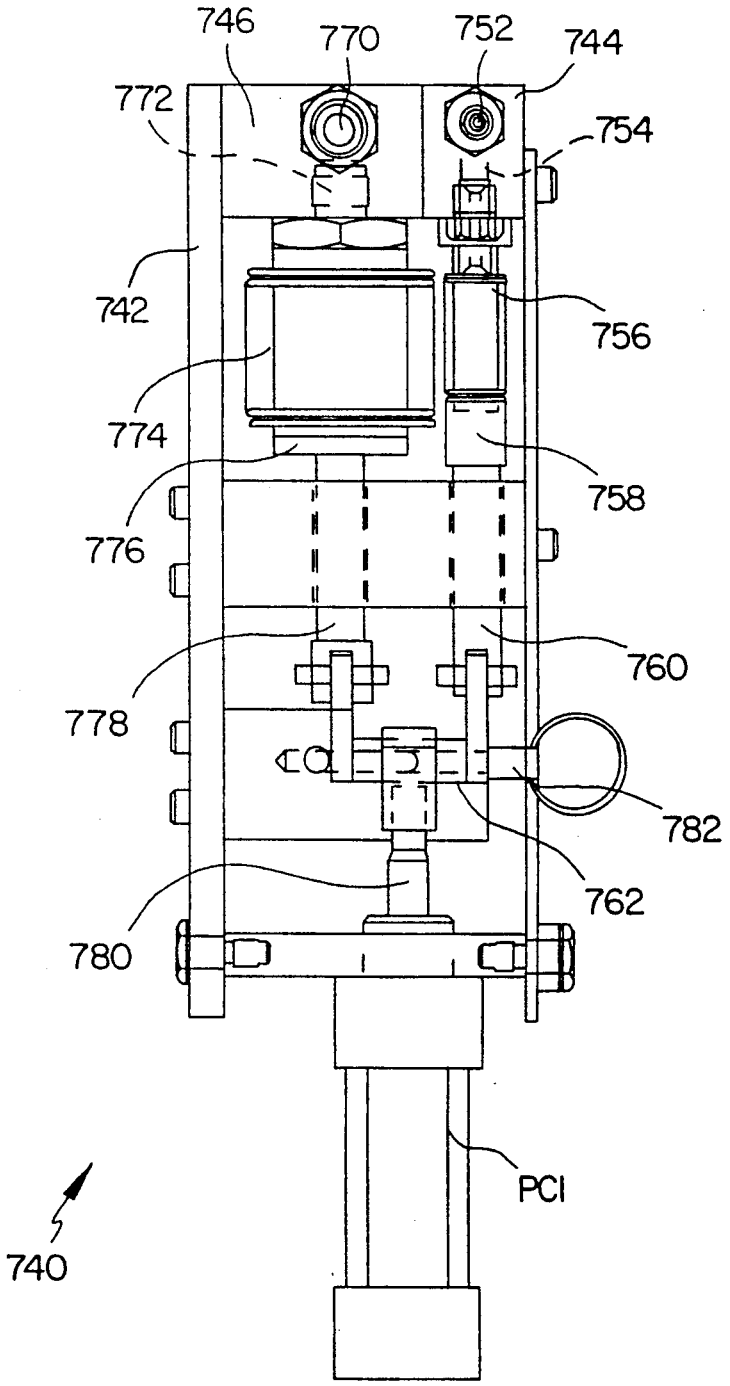

The tube 382, which forms part of an adhesive supply system of the device in accordance with the invention, is connected, via bores 710, 712, 714 and 716 (FIG. 2) respectively formed in the block 376, a fitting 718, the rotary coupling 380 and an end cap 720 and via a fitting 722 secured to said end cap 720, with a flexible pipe 724 connected to a supply of adhesive, as will be referred to hereinafter. In addition, extending through the tube 382 and bores 710, 712, 714 and through a side wall of the bore 716 is a second tube 726, the lower end of which terminates just short of the ball 392 and the upper end of which passes through a fitting 728 secured in the end cap 720. The fitting 728 has a conical end in which a complementarily shaped conical sleeve 732 is matingly and sealingly accommodated. The sleeve 732, which is swaged on or otherwise secured to the tube 726, is clamped in position by a threaded nut 734 secured to the fitting. The tube 726 is connected, via a supply pipe 736 (FIG. 6), to a source of a hardener for the adhesive supplied along the tube 724.

Figure 5:
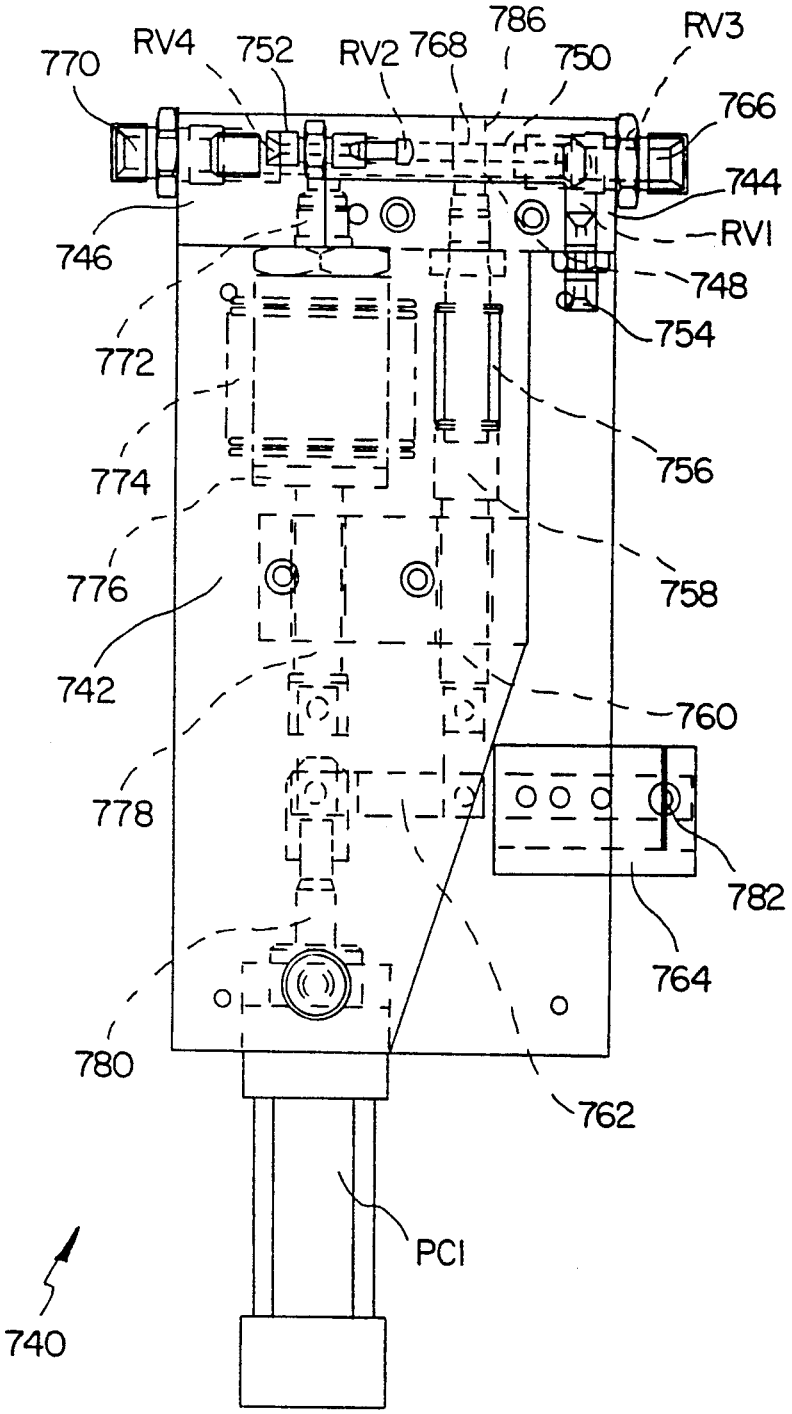
FIGS. 5 and 6 are side and end views respectively of a metering system forming part of the applicator device in accordance with the invention.

The adhesive supply system of the applicator device in accordance with the invention also comprises a metering system (FIGS. 5 and 6) for metering quantities of two components which when mixed will form an adhesive composition, said components being supplied to the applicator device 380 along the supply tubes 382, 726. The metering system comprises a frame 742 supporting first and second manifold blocks 744, 746. The manifold block 744, which is arranged for the supply of hardener (constituting a first component of the adhesive composition) comprises an inlet port 748 and internal passageway 750 extending through the block 744 and opening at an outlet port 752 to which the pipe 724 is connected. Non-return (restrictor) valve arrangements RV1, RV2 are associated respectively with the inlet and outlet ports 744, 752 whereby the flow of hardener in a direction from the outlet to the inlet port is prevented. A branch line 754 opening into the passageway 750, between the two valve arrangements RV1, RV2, said branch line leading to a variable-volume container in the form of a bellows unit 756 secured to the underside of the block 744. The bellows unit 756 is a unitary collapsible element, being substantially closed except for the inlet/outlet by which it is connected to the branch line 754. The lower end cap 758 of the unit 756 is connected by an articulated linkage 760 to a lever 762, which is mounted for pivotal movement on a block 764 secured to the frame 742, as will be discussed in detail later.

The manifold block 746 also has an inlet port 766 for the supply of adhesive and an internal passageway 768 extending through the block 746 and opening at an outlet 770 to which the pipe 382 is connected. Non-return (restrictor) valve arrangements RV3, RV4 are associated respectively with the inlet and outlet ports 766, 770, preventing the flow of adhesive in a direction from the outlet to the inlet port. A branch line 772 opens into the passageway 768 between the two valve arrangements RV3, RV4, said branch line leading to a further variable-volume container in the form of a bellows unit 774. This unit is substantially larger than the bellows unit 756, since the amount of hardener in the adhesive composition is expected to be in the order of 3% to 5% of the volume of the composition as a whole. The unit 774 has an end cap 776 which is connected by an articulated linkage 778 to the lever 762, at its end remote from its pivot point.

Also connected to the lever 762, at the same point as the articulated linkage 778 is one end of a piston rod 780 of a piston-and-cylinder arrangement PC1. Actuation of the arrangement PC1 is thus effective to pivot the lever 762 about its pivot and thus, through the linkages 760, 778, to increase or decrease the volume of each of the bellows units 756, 774. Moreover, by reason of the particular arrangement just described, it will be appreciated, the rate of flow of the components from each of the two bellows units will remain at a constant ratio throughout the decrease in the volume of each container (and indeed the rate of drawing components into the containers will also be similarly controlled) by reason of the arrangement of the lever 762.

For adjusting the ratio between the two flow rates the block 764 is provided with a plurality of (in the particular case four) holes in any one of which a pivot pin 782 can be accommodated, an equivalent number of holes also being provided in the lever 762, such that they coincide with the holes in the block 764 when the lever is in a horizontal condition, i.e. in its rest position. By selecting one or other of the four holes for the pivot pin 782, the geometry of the pivotal action of the lever 762 in response to actuation of the piston-and-cylinder arrangement PC1 is varied, and thus the ratio of the flow rates of components from the two containers 756, 774 is adjusted.

Figure 7:
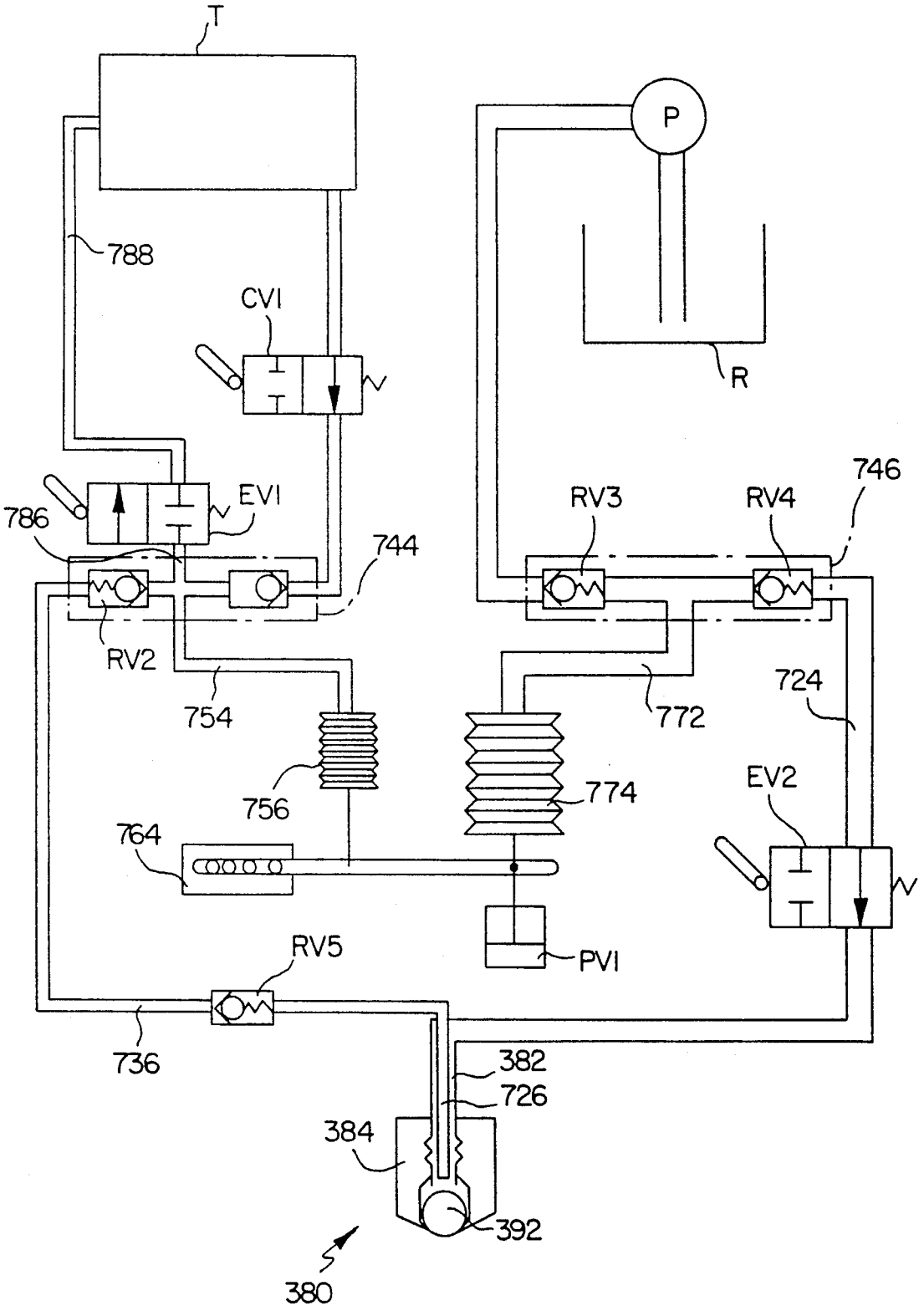
FIG. 7 is a schematic view of an adhesive supply system forming part of the applicator device in accordance with the invention.

FIG. 7 shows a flow diagram of the adhesive supply system described above. From this diagram it will be seen that the hardener is contained in a tank T and is fed under gravity through an on/off control valve CV1 to the input port of the manifold block 744. To this end, it will further be noticed, regulator valve RV1 is not provided with a spring but rather allows free flow of the hardener under the gravity feed. The regulator valve RV2 on the other hand is provided with a spring and serves to prevent continuous flow of the hardener through the system except when fed past regulator valve RV2 under pressure from the bellows unit 756. The manifold block 744 has a further branch line 786 to which is connected a venting valve arrangement EV1, again manually operable, for allowing air to vent from the bore 750 and branch line 754 through a return line 788 which connects to the tank T. It will be appreciated that, because of the gravity feed arrangement involved, when the valve arrangement EV1 is open the fluid in the return pipe 788 will seek the same level as the fluid in the tank T, thereby eliminating air from that portion of the system which includes the branch line 754, bellows unit 756 and manifold block 744. As the volume of the bellows unit 756 increases hardener is drawn thereinto, without pressure. When the volume is decreased, under the action of piston-and-cylinder arrangement PC1, the hardener is expelled from the bellows unit 756 in a direction towards the applicator head 380, regulator valve RV2 yielding to such pressure. Also arranged in the line 736 is a further non-return (restrictor) valve arrangement RV5 which also allows the passage of the hardener to the ball 392 of the applicator head 380. The valve arrangement RV5 does however prevent backflow of adhesive and hardener when the system is pressurised and the ball 392 is in its sealing position.

The supply system for the adhesive itself is pressurised, and indeed comprises a pressurised pot arrangement consisting e.g. of a reservoir R and pump P, by which fluid under pressure is supplied to the input port of the manifold block 746. The pressure under which the adhesive is maintained by this system in fact pressurises the whole of the adhesive supply system but is less than the pressure which is applied by the decrease in volume of the bellows units 756, 774. The operation of the bellows unit 774 is the same as for the unit 756 and serves to cause a metered quantity of adhesive to be supplied to the ball 392 as above described.

At the end of a working day it is desirable that no mixture of adhesive and hardener remain in the system; otherwise that will cure overnight leading to a problem of blockage at the start of the next shift. In order to avoid this problem, therefore, while at the same time preventing any risk of drooling from the applicator head between shifts, an on/off flow control valve EV2 is provided in the line 724. At the end of the working day the valve EV2 is switched to an "off" position and an end piece (not shown) is attached to the applicator head which holds the ball 392 out of its sealing position.

In this situation the valve EV2 is then once more opened and the pressure from the pressurised pot arrangement urges adhesive through the line 724, flushing out any hardener remaining in the vicinity of the ball 392. It is to be noted that hardener may remain in the tube 726 "downstream" of valve RV5 without problem; the problem would be if any hardener remains in the applicator head beyond the end of the pipe 726. After a relatively small amount of adhesive has been thus flushed through, valve EV2 is again closed and the attachment to the applicator head removed. The ball 392 thus moves back to its sealing position. With the valve arrangement EV2 remaining closed, the clamping nut 734 is then released and the pipe 726 removed from within the body of the applicator device. The pipe may be placed e.g. in a container of solvent until it is next required for use. A suitable plug (not shown) is provided to be screwed on the fitting 728.

In operating the machine described above, it will be appreciated that, because the adhesive and hardener are maintained separate until they reach the vicinity of the ball, they tend to be applied to the workpiece surface separately, but in the desired ratio. The action of the rotary brush element 398 is then effective not only to "scrub" the adhesive composition into the surface of the workpiece, but also to ensure that proper mixing of the two components takes place. In the operation of the machine, furthermore, the adhesive composition is applied progressively around the margin of the shoe bottom and, in order to ensure delivery of adhesive at a rate which is commensurate with the speed of traverse of the tool along the shoe bottom, the operation of piston-and-cylinder arrangement PC1 is controlled accordingly. Moreover, in order to ensure that adhesive is ready for delivery as soon as the ball 392 is moved out of its sealing position by engagement with the shoe bottom, a control signal is provided, at the time when the machine signals the tool supporting means to advance towards the workpiece, to supply fluid under pressure to said piston-and-cylinder arrangement PC1 and thus pressurise the system by initiating the decrease in volume of the two bellows units 756, 774.

In practice, it has been found desirable, in order to prevent over-flexing of the two bellows units 756, 774, to utilise a relatively short stroke of the piston-and-cylinder arrangement PC1; this has also the benefit that, where more adhesive is required, the stroke can be lengthened without recourse to two or more strokes of the unit for a single workpiece application.

We claim:

1. An applicator device for applying a multi-component composition to a workpiece surface, said device comprising:

a rotary applicator head;

means to separately supply each component to said rotary applicator head, said head comprising a ball member captively accommodated within a housing a which provides an outlet through which said components can flow from the applicator head, such flow being controlled by the ball member, and wherein two components are separately supplied to the region of a portion, remote from the outlet, of the surface of the ball member whereby each component flows substantially unmixed with the other over the ball surface to the outlet and by which the components are applied to the workpiece surface;

the arrangement being such that mixing of the components is substantially effected on the workpiece surface by rotation of the applicator head while pressed against the surface.

2. A device according to claim 1 wherein the applicator head further includes a rotary brush assembly.

3. A device according to claim 1 wherein the applicator head further comprises a rotary brush assembly mounted on the housing with bristles thereof projecting beyond the end face of the housing in which the outlet is provided, the arrangement being such that when the applicator head is pressed against the workpiece surface the bristles of the brush assembly deform and spread over the workpiece surface.

4. A device according to claim 3 wherein the ball member projects from the outlet in the housing, spring means being provided for urging it into a sealing condition thus to prevent the flow of the components form the outlet, and the ball member being movable against the spring pressure out of such sealing condition thus to allow the flow of the components through the outlet, means to maintain the ball member in a position projecting from the outlet when moved out of its sealing condition, and the ball member thus being able to be pressed against the workpiece surface and thus to determine the amount of deformation and spread of the bristles of the brush assembly.

5. A device according to claim 1 wherein tubular supply elements are connected each to a supply of one of the components, each of which elements terminates in the applicator head and thus serves to supply its component thereto as aforesaid.

6. A device according to claim 5 wherein two supply elements are provided, one of which is accommodated within the other.

7. A device according to claim 6 wherein said one element is readily removable from the other.

8. A device according to claim 1 in combination with a metering system which comprises a variable-volume container for each component, and control means effective, when expelling components from their containers, to control the rate of decrease of the volume of each container, and thus the flow rate at which the quantity of each component is expelled from its container, such that the ratio between the flow rates from the containers is maintained constant.

9. A device according to claim 8 wherein each variable-volume container is constituted by a collapsible container which, except for an inlet/outlet, is otherwise closed.

10. A device according to claim 1 having a metering system for supplying two or more flowable components to the applicator head, said system comprising for each component a collapsible container which, except for an inlet/outlet, is otherwise closed, wherein control means is provided effective, when expelling components from their containers, to control the rate of decrease of the volume of each container, and thus the flow rate at which each component is expelled from its container, such that the ratio between the flow rates from the containers is maintained constant.

11. A device according to claim 10 wherein the control means is also effective, prior to such expulsion, to cause a quantity of each component to be supplied to its container, the quantities thus supplied being in the same ratio as the ratio between their flow rates from the containers.

12. A device according to claim 10 wherein the control means comprises a single motor acting through a linkage including a pivotal lever to which each container is connected for collapsing it.

13. A device according to claim 12 wherein the pivot pin about which the pivotal lever can pivot can be adjusted in a direction along the length of the lever thus to adjust the ratio between the flow rates from the containers.

14. A device according to claim 10 wherein each collapsible container is constituted by a bellows unit.

15. A device according to claim 11 wherein one of the components is supplied as aforesaid to its container under pressure and the other under gravity.

16. A device according to claim 1 having an adhesive supply system for supplying two components, said system comprising a gravity feed system for supplying a first of the components to a first variable-volume container, and a pressurised feed system for supplying a second of the components to a second variable-volume container.

17. A device according to claim 16 further comprising a metering system comprising control means for causing the volume of each container to be decreased at a controlled rate whereby to control also the flow rate at which the component contained therein is expelled therefrom, the thus expelled components being supplied, separately from one another, to the applicator head, whereafter they can then be mixed.

18. A device according to claim 17 wherein a first supply line extends from a tank, forming part of the gravity feed system, to the applicator head, the first container being connected into said first supply line via a first branch line, and a second supply line extends from a pressure source, forming part of the pressurised feed system, to the applicator head, the second container being connected into said second supply line through a second branch line.

19. A device according to claim 18 wherein the pressure in the second supply line is maintained at the pressure created by the pressure source, but is increased when the metering system is operated to cause the volume of the second container to be decreased and the component contained therein thus to be expelled into the second supply line, a restrictor valve arrangement being provided "upstream" of the branch line to direct the component flow towards the applicator head.

20. A device according to claim 19 wherein a further restrictor valve arrangement is arranged in the second supply line just "downstream" of the second branch line.

21. A device according to claim 18 wherein a restrictor valve arrangement is provided in the first supply line, "upstream" of the first branch line, to direct the component flow in a direction towards the applicator head.

22. A device according to claim 21 wherein a further restrictor valve arrangement is provided in the first supply line, "downstream" of the first branch line, whereby component flow in a direction away from the applicator head is prevented.

23. A device according to claim 22 wherein a venting valve arrangement is arranged in a section of the first supply line between said restrictor valve arrangements, whereby air in said section can be vented.

24. A device according to claim 17 wherein there is arranged at the applicator head a shut-off valve for preventing component flow from the system.

25. A device according to claim 24 wherein sequence control means is provided whereby operation of the metering system is initiated prior to the opening of the shut-off valve.

26. A device according to claim 17 wherein the metering system comprises control means effective, when expelling components from their containers, to control the rate of decrease of the volume of each container, and thus the flow rate at which the quantity of each component is expelled from its container, such that the ratio between the flow rates from the containers is maintained constant.

27. A device according to claim 26 wherein the control means is also effective, prior to such expulsion, to cause a quantity of each component to be supplied to its container, the quantities thus supplied being in the same ratio as the ratio between their flow rates from the containers.

28. A device according to claim 26 wherein the control means comprises a single motor acting through a linkage including a pivotal lever to which each container is connected, the arrangement being such that pivotal movement of the lever is effective to increase or decrease the volume of each container as aforesaid.

29. A device according to claim 28 wherein the pivot point about which the pivotal lever can pivot is adjustable in a direction along the length of the lever thus to adjust the ratio between the flow rates from the containers.

30. A device according to claim 16 wherein each variable-volume container is in the form of a collapsible container which, except for an inlet/outlet, is otherwise closed.

31. A device according to claim 30 wherein each collapsible container is constituted by a bellows unit.

32. A device according to claim 24 wherein the shut-off valve comprises a ball valve arrangement which is opened by the ball thereof being pressed against a workpiece surface to which the adhesive composition is to be applied.

33. A device according to claim 32 wherein the ball of the ball valve arrangement is captively accommodated in a housing forming part of the rotary applicator head, which housing provides an outlet through which the components can flow from the head under the control of the ball, and wherein the components are separately supplied to the applicator head in the region of a portion, remote from the outlet, of the surface of the ball, whereby each component flows, substantially unmixed with the other, over the ball surface to the outlet, and further wherein the rotary applicator head also comprises an annular operating surface portion which surrounds the outlet and by which, as the head rotates while being pressed against the workpiece surface, the components applied as aforesaid to the workpiece surface are mixed thereon.

34. A device according to claim 33 wherein the annular operating surface portion of the head is constituted by a rotary brush assembly.

35. A device according to claim 34 wherein the brush assembly is mounted on the housing and bristles thereof project beyond the end face of the housing in which the outlet is provided, the arrangement being such that when the applicator head is pressed against the workpiece surface the bristles of the brush assembly deform and spread over the workpiece surface.

36. A device according to claim 16 wherein the adhesive supply system comprises two tubular supply elements are connected each to one of the containers for the components and each of which terminates in the applicator head and thus serves to supply its component thereto as aforesaid.

37. An adhesive supply system according to claim 36 wherein one of the elements is accommodated within the other.

* * * * *